United States Patent [19]

Aujla et al.

[11] Patent Number: 4,682,835

[45] Date of Patent: Jul. 28, 1987

[54] INSULATION DISPLACING TERMINAL WITH CANTILEVER SPRING CONTACT MEMBERS

[75] Inventors: Sharanjit S. Aujla, Kanata; George Debortoli; Remo Contardo, both of Ottawa, all of Canada

[73] Assignee: Northern Telecom Limited, Montreal, Canada

[21] Appl. No.: 935,135

[22] Filed: Nov. 26, 1986

Related U.S. Application Data

[63] Continuation of Ser. No. 721,259, Apr. 8, 1985, abandoned.

[51] Int. Cl.[4] ..... H01R 11/20

[52] U.S. Cl. ..... 439/395; 439/396

[58] Field of Search ..... 339/97 R, 97 P, 98, 339/99 R

[56] References Cited

U.S. PATENT DOCUMENTS

| | | | |
|---|---|---|---|
| 3,521,221 | 7/1970 | Lenaerts et al. | 339/97 P |
| 3,636,500 | 1/1972 | Sedlacek | 339/97 R |
| 4,002,391 | 1/1977 | Dunn et al. | 339/98 |
| 4,317,608 | 3/1982 | Déchelette | 339/99 R |
| 4,449,777 | 5/1984 | Baribeau | 339/99 R |
| 4,527,857 | 7/1985 | Hughes et al. | 339/97 R |

*Primary Examiner*—Gil Weidenfeld
*Assistant Examiner*—Paula A. Austin
*Attorney, Agent, or Firm*—Schwartz, Jeffery, Schwaab, Mack, Blumenthal & Evans

[57] ABSTRACT

An insulation displacing terminal has opposed cantilever spring contact members having two portions, lower and upper. The lower portions have their outer edges inclined upward and inward to give a first tapered portion. The upper portions have the outer edges inclined upward and outward to give second tapered portions. The upper and lower portions join at a neck or narrow section. The upper portions are of reduced thickness relative to the lower portions, the reduced thickness starting just above the neck section.

9 Claims, 12 Drawing Figures

INSULATION DISPLACING TERMINAL WITH CANTILEVER SPRING CONTACT MEMBERS

This application is a continuation of application Ser. No. 721,259, filed Apr. 8, 1985 now abandoned.

This invention relates to insulation displacing terminals having cantilever spring contact members, and is particularly concerned with such terminals for use with telecommunications conductors, such as drop wires to customers premises. It is a feature of the invention that the terminals will accept a range of conductor sizes.

Insulation displacing terminals are well known. With such terminals, an insulated conductor is pushed down between two cantilever members. In so doing insulation is displaced from around the conductor so that the conductive core makes electrical contact with the cantilever members. Some terminals have cutting edges extending normal to the axis of the conductor, the cutting edges cutting through the insulation, and usually also cutting into the conductive core somewhat. This can lead to conductor breakage. Other terminals have cutting edges extending parallel to the axis of the conductor and these actually displace a small length of insulation off of the conductor. Some slight deformation of the conductive core may be occasioned. U.S. Pat. Nos. 3,521,221 issued July 21, 1970 and 4,002,391 issued Jan. 11, 1972 in the name of the present assignee, are examples of two of such terminals. Other terminals rely on crushing the insulation with the possibility that some insulation may remain trapped between the terminal and the conductive core.

In the majority of uses of these terminals it is desired to be able to insert, remove and reinsert conductors many times. Therefore the terminals must not be overstressed. Terminals are often held in plastic connectors or other members, retained in position by laterally extending sprags or tines. It is therefore desirable to keep insertion and removal forces to a minimum to avoid damaging terminals or displacing them in a connector. At the same time a minimum contact force is necessary between terminal and conductor to ensure a satisfactory connection. Terminals usually accept only one size or gage of conductor, because of the various constraints.

The present invention provides a terminal which has improved insulation stripping or displacing and reduced insertion forces. At the same time an improved stress distribution and increased compliance is obtained. A reusable terminal having a smaller overall size, which accepts a range of conductor sizes and insulation types, and is rugged and can be economically produced by stamping, results.

Broadly, a terminal comprises two cantilever spring contact members having opposed edges, between which a conductor is pushed, the top edges of the contact members forming a shallow Vee formation, with the intersections of top edges and opposed edges forming insulation slicing edges. The contact members extend up from a unitary base. At the lower portions of the contact members a slot is formed between the contact members, and the upper portions are spaced apart a small initial distance by a swage on one of the contact members. The lower portions taper upward and inward and the upper portions taper upward and outward. The upper portions are of reduced thickness, relative to the lower portions. The reduced thickness of the upper portions extends down to below the rest point of a conductor in the terminal, and preferrably stops short of the congruence of the upper and lower tapers. On the side of the base remote from the contact members, a further insulation displacing terminal may be formed. Means may be provided for retaining the terminal in a connector or other holding member or housing.

The invention will be readily understood by the following description of various embodiments, by way of example, in conjunction with the accompanying drawings, in which.

Figure 1:
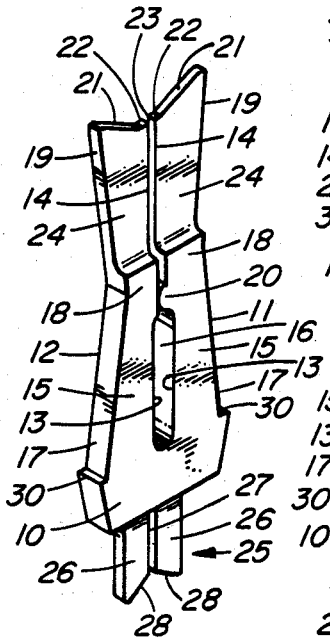
FIG. 1 is a perspective view of a terminal.

As illustrated in FIG. 1 a terminal comprises a base 10 from which extend two cantilever contact members 11 and 12. The terminal conveniently is formed from flat strip material, with the contact members co-planar and having opposed edges which are in two parts, lower parts 13 and upper parts 14.

The upper and lower parts of the opposed edges correspond generally with upper and lower portions of the contact members. The lower portions 15 of each contact member are defined at the inner edges by a slot 16, the sides of the slot defined by the lower parts 13 of the opposed edges. The outer edges 17 of the lower portions 15 incline upward and inward from the base to a narrow, or neck, section 18 which is positioned just above the top end of the slot 16.

The upper portions are defined by the upper parts 14 of the opposed edges and by outer edges 19 which incline upward and outward from the narrow or neck section 18. Between the top end of the slot 16 and the narrow section 18, one of the terminal members is swaged at its inner edge, at 20. The swaging preloads the terminal members apart a small distance such that the upper parts 14 of the opposed edges are spaced slightly. The spacing of the upper parts 14 of the opposed edges is less than the diameter of the smallest size, or gage, of conductor to be inserted.

The upper portions 24 of the contact members are of reduced thickness relative to the lower parts and the base. The reduced thickness extends from slightly above the narrow section 18 up to the top edges 21 of the contact members. The top edges, incline upward and outward from the opposed edges, therebeing a small section 22, extending from the opposed edge, normal thereto, on each contact member. The intersection of each section 22 with the related upper part 14 of the opposed edges defines a cutting edge 23 extending for the thickness of the upper portion of each contact member.

Extending from the base 10 in the opposite direction to the contact members 11 and 12 is a further terminal indicated generally at 25. This terminal has two legs 26 having spaced opposed inner edges 27. The lower edges 28 of the legs 26 incline upwards and inwards. In some instances the terminal 25 may not be provided, or may take some other form.

At each edge of the base 10 is formed a barb or tang 30. Terminals may be inserted in a connector, or other holder, by being pushed in. Once inserted the barbs or tangs 30 retain the terminal in position, against forces which can be applied when a conductor is pulled out from between the contact members 11 and 12. However, this is only one form of retaining a terminal in place. It is possible, for example, that terminals be held in position by barbs extending normally to the plane of the terminal. Also, terminals could be molded in place, with one or more holes extending through the base 10.

Figure 2:
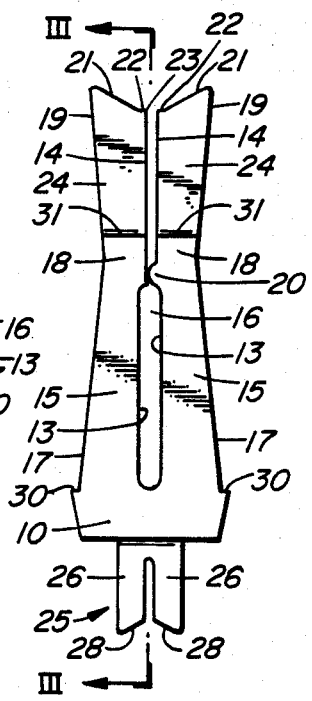
FIG. 2 is a front view of a terminal as in FIG. 1.
Figure 3:
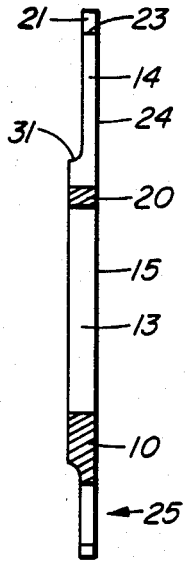
FIG. 3 is a cross-section on the line III—III of FIG. 2.

FIGS. 2 and 3 illustrate the terminal illustrated in FIG. 1. In FIG. 2 there is readily seen the slight spacing of the upper parts 14 of the opposed edges and also the relative positioning of the narrow section 18, swage 20 and the lower limit 31 of the reduced thickness of the upper portions of the contact members.

Figure 4:
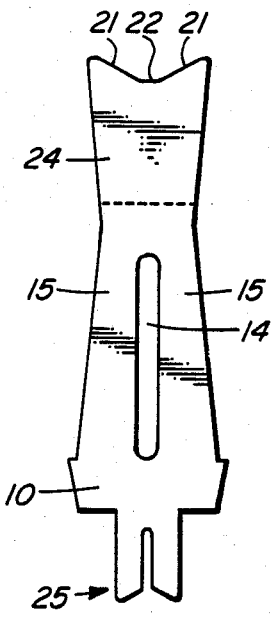
FIG. 4 illustrates a typical blank prior to slitting for form contact members, and prior to swaging.

FIG. 4 illustrates a typical blank prior to slitting to form the upper parts 14 of the opposed edges and also prior to swaging to open the upper parts 14. The terminals are readily formed from strip material having a cross-section as seen from FIG. 3. The grain direction of the metal is along the strip that is transverse of the contact members 11 and 12.

The terminal is used as follows. An insulated conductor is positioned on the top edges 21 of the contact members, being centered to some degree by the inclination of the top edges. As the conductor is pushed down between the opposed edges 14, the cutting edges 23 make short cuts in the insulation, parallel to the axis of the conductor. A section of insulation is then pushed up off of the conductor as the core of the conductor moves down between the edges 14. This is described and illustrated in the above mentioned U.S. Pat. No. 3,521,221. Forcing of the conductive core of the conductor down between the edges 14 forces the contact members 11 and 12 apart.

The use of different thicknesses of material for the upper and lower portions of the contact members provides several advantages. The reduced material thickness of the upper portions 24 results in a lower insertion force, as a result of a reduced area of contact between conductive core and contact members. There is an increase in the ratio of normal force to material thickness at the entry point—cutting edges 23—which improves stripping of insulation. There is also an increase in the ratio of normal force to material thickness at the final position of rest of the conductor, giving a more stable connection. It also enables a smaller overall terminal.

Figure 6:
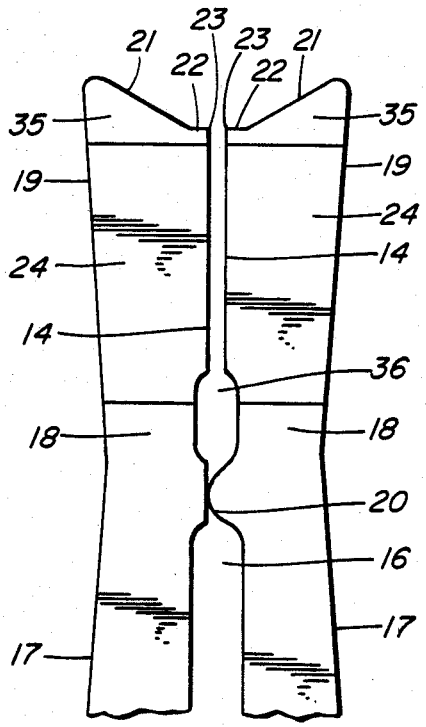
FIG. 6 is a part front view of a terminal illustrating two modifications.
Figure 7:
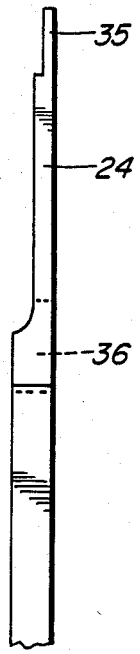
FIG. 7 is a side view of the terminal in FIG. 6.

FIGS. 6 and 7 illustrate two modifications which can be made to the terminal as illustrated in FIG. 1. The two modifications can be made individually, or both may be made at the same time.

Firstly, for conductors having thick and/or hard insulation, the insertion force required to cause displacement of the insulation can be sufficient to cause damage to the terminal and/or the conductor. The terminal of the invention is intended to be capable of accepting a range of conductor sizes and types. To reduce the insertion force, or insulation displacement force, a modification is to reduce the thickness of the top parts of the upper portions 24. This is illustrated in FIGS. 6 and 7, the upper portions 24 being reduced in thickness at the top parts 35. The top parts are shown reduced in thickness, in the example, to about half the thickness of the rest of the upper portions. Reducing the thickness of the upper portions 24 of the cantilever members gives a shorter cutting edge 23 on each cantilever member, requiring a reduced initial insertion force to initiate cutting and displacement of insulation. As a conductor is pushed down between the opposed edges, further displacement of insulation occurs.

Also illustrated, in FIG. 6 particularly, is an enlargement or aperture 36 formed at the lower ends of the opposed edges 14. It can happen, particularly in cold temperatures, that the insulation on a conductor is hard. In such circumstances, the insulation trapped between the opposed edges 14, below the conductor core, instead of being squeezed out by the beam action of the cantilever contact members, remains between the contact members and acts as a wedge. As the conductor, and the insulation, is pushed down, the insulation can force the cantilever contact members apart to an extent which at least severely reduces the contact between the contact members and the conductive core of the conductor.

By providing the aperture or enlargement 36, the insulation below the core can be caused to be removed from between the edges 14. The conductor is inserted into the terminal by a tool which can be preset to determine where the conductor will be positioned between the edges 14. Thus, the tool can be pushed down until a datum surface engages with the top of the terminal. This sets the position of the conductor. Therefore, the conductor can readily be inserted such that the conductive core is between the edges 14 just above the aperture 36, while the insulation below the core is in the aperture. The insulation will not then affect the contact conditions between the cantilever contact members and the core. The aperture 36 can be provided in terminals as in FIGS. 1, 2 and 3 also.

By positioning the narrow section 18 below the transition from reduced material thickness to normal thickness a reduction in stress concentration at the narrow section is obtained. The thicker material of the lower portions of the contact members and the tapered form gives more uniform stress distribution and increased compliance at entry and at conductor rest position.

The particular form of terminal provides a reusable member having improved elastic compliance and more uniformly distributed stresses. The terminal accepts a range of conductor sizes, e.g. 24 AWG to 18 AWG copper wire. The terminal also accepts and strips effectively a range of insulation materials, e.g. paper pulp, PVC and PVC/styrene butadune rubber. The terminal is smaller overall, resulting in a smaller package in use. The terminal is a relatively low cost, rugged, stamped member.

Figure 5:
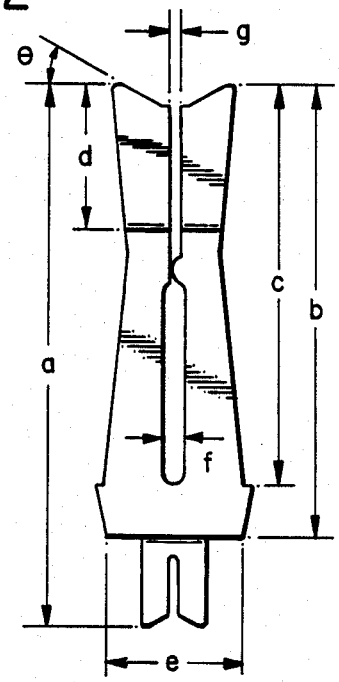
FIG. 5 is the same view as FIG. 2, with typical dimensions.

Purely as an example, for the conductor sizes stated above, typical dimensions for a terminal are as follows, referring particularly to FIG. 5: (a) 0.804 inches; (b) 0.67 inches; (c) 0.61 inches; (d) 0.22 inches; (e) 0.195 inches; (f) 0.35 inches; (g) 0.007 inches; $\theta 30°$. The thickness of the main parts of the contact members 11 and 12 is 0.035 inches, while the thickness of the upper portions 24 is 0.016 inches. The thickness of the legs 26 is also 0.016 inches. The thickness of the top parts 35 is 0.008 inches. A typical material is berylium copper.

Figure 9:
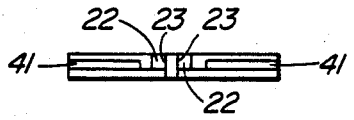
FIGS. 8, 9 and 10 are part front view, top end view and side view respectively illustrating a further modification.
Figure 8:
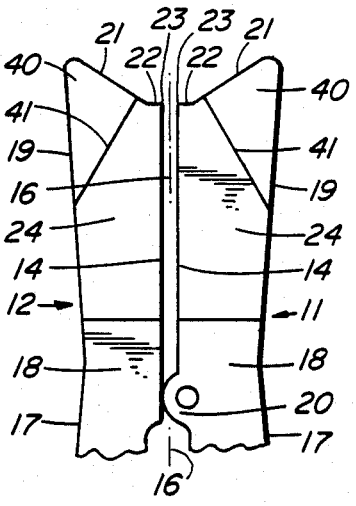
Figure 10:
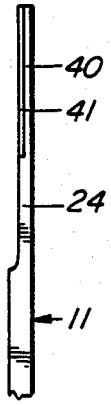

FIGS. 8, 9 and 10 illustrate a further modification, particularly, but not exclusively, suitable for a large gage drop wire, for example 18 AWG. Such drop wires have a relatively large insulation layer and this can be used to restrict deflection of the spring contact members. In FIGS. 8, 9 and 10, the same reference numerals are used to identify the same details as in FIGS. 1 to 7, where applicable.

As illustrated in FIGS. 8, 9 and 10, the upper portions 24 of the spring contact members 11 and 12 are of reduced thickness, as in FIGS. 1 to 4. In the example in FIGS. 8, 9 and 10, the top upper angular portions or "horns" 40 are further reduced in thickness forming an inclined edge or ramp 41 extending downwardly and outwardly from the top edge 21 to the outer edge 19.

The reduced thickness of the outer parts of the edges 21 provides a better cutting action during the initial insertion of a drop wire, for example an 18 AWG drop wire. The remaining parts of the top edges and the flat sections 22 provide the required cutting forces for smaller gage wires, for example 22 and 24 AWG, with smaller overall insulation.

Figure 11:
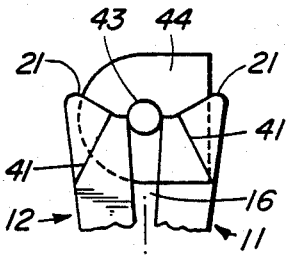
FIG. 11 illustrates the entry of a conductor into a terminal as in FIGS. 8, 9 and 10.

The ramp 41 becomes effective as a large drop wire is inserted. Initially, the insulation is cut into by the top edge 21. When the insulation meets the top end of the ramp 41—at 42, the insulation to the outside of the point 42 moves into contact with the ramp 41. This creates a wedge effect which opposes the effect of the upwardly and outwardly inclined top surfaces 21. This restricts bending or deflection of the contact members 11 and 12. The conductive core of the drop-wire eventually enters the slot 16. FIG. 11 illustrates the condition of the conductor 43 just entered in the slot 16. The conductor 43 will be pushed down slightly further into the slot. The insulation 44, in the example, is D-shaped. A drop wire is conventionally a twin conductor structure, with the two conductors forming a single drop wire united by a thin web on the flat surfaces of the insulation. This web is slit before insertion of the conductor.

Figure 12:
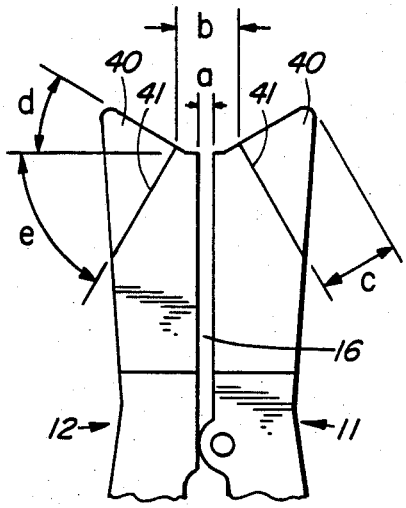
FIG. 12 is a view similar to that of FIG. 7 showing an example of dimensions for a particular terminal.

The following dimensions and angles are typical values for an 18 AWG copperweld drop wire, referring to FIG. 12. (a) 0.011 inches; (b) 0.050 inches; (c) 0.065 inches; (d) 30°; (e) 60°. The thickness of the upper part 24 is about 0.016 inches and the thickness of the upper portions or "horns" 40 is about 0.008 inches.

The terminal as illustrated in FIGS. 9 to 12 will also be quite effective with large gage wires with circular cross-section insulation.

What is claimed is:

1. An insulation displacing terminal comprising:

a base;

two cantilever spring contact members having a relatively wide transverse width and a relatively narrow thickness and extending up from said base, the contact members having top edges and opposed inner edges between which a conductor is pushed, the intersections of said top edges and said opposed inner edges defining insulation slicing edges;

each contact member having a lower portion and an upper portion, the lower portions having upwardly and inwardly inclined outer edges and the upper portions having upwardly and outwardly inclined outer edges, the upper and lower portions congruent at a neck section;

a slot extending between the inner edges of the lower portions and a swage on one of said contact members on the inner edge thereof, the swage positioned immediately above said slot and spacing said inner edges of said upper portions slight apart;

said upper portions defining a conductor receiving part; and said upper portions being of a reduced cross-sectional thickness relative to the thickness of said lower portions for at least a major part of the distance from said top edges toward said neck section.

2. A terminal as claimed in claim 1, said upper portions of said spring contact members each having a top part extending below and adjacent to said insulation slicing edges, said top parts being of reduced thickness relative to the remainder of the upper portions.

3. A terminal as claimed in claim 1, including a further insulation displacing formation extending from said base, in an opposite direction to said cantilever spring contact members, said further insulation displacing formation comprising two cantilever legs having spaced opposed inner edges, said legs each having a lower edge inclined upward and inward to said inner edge.

4. A terminal as claimed in claim 1, including barbs on said base, a barb formed at each side edge of said base, each barb defined by an upwardly and outwardly inclined side edge and an inwardly directed top edge merging into the outer edge of the lower portions of the spring contact member.

5. A terminal as claimed in claim 1, said upper portions of said spring contact members each having a top upper part of reduced thickness relative to said reduced thickness of said upper portions, each said top upper part defined by an inclined edge extending downwardly and outwardly from the top edge to the outer edge.

6. A terminal as claimed in claim 1, said swage positioned below and immediately adjacent to said neck section.

7. A terminal as claimed in claim 6, said reduced thickness of said upper portions extending to a transition position adjacent to and immediately above said neck section.

8. A terminal as claimed in claim 1, including an apertured formed between said spring contact members immediately above said swage, the aperture extending up between said upper portions.

9. A terminal as claimed in claim 8, said aperture extending across the transition of thickness in said upper portions.

* * * * *